US006820656B2

(12) United States Patent
Burton

(10) Patent No.: US 6,820,656 B2
(45) Date of Patent: Nov. 23, 2004

(54) YARN TUFT FORMING UNIT AND LOOM

(75) Inventor: Michael Winspear Burton, West Midlands (GB)

(73) Assignee: Brintons Limited, Kidderminster (GB)

( * ) Notice: Subject to any disclaimer, the term of this patent is extended or adjusted under 35 U.S.C. 154(b) by 0 days.

(21) Appl. No.: 10/276,677

(22) PCT Filed: May 11, 2001

(86) PCT No.: PCT/EP01/05397

§ 371 (c)(1),
(2), (4) Date: Jun. 26, 2003

(87) PCT Pub. No.: WO01/88241

PCT Pub. Date: Nov. 22, 2001

(65) Prior Publication Data

US 2004/0099326 A1 May 27, 2004

(30) Foreign Application Priority Data

May 15, 2000 (EP) ..... 00304053

(51) Int. Cl.[7] ..... D03D 39/00
(52) U.S. Cl. ..... 139/7 A; 139/7 F
(58) Field of Search ..... 139/7 A, 2, 7 R, 139/8, 7 B, 7 C, 7 D, 7 E, 7 F, 7 G

(56) References Cited

U.S. PATENT DOCUMENTS 3,415,209 A * 12/1968 Ellison et al. ..... 139/7 R
4,039,007 A * 8/1977 Coleman et al. ..... 139/7 F
5,743,306 A * 4/1998 Stewart et al. ..... 139/7 A
6,220,307 B1 * 4/2001 Griffith ..... 139/7 A
6,289,938 B1 * 9/2001 Dewispelaere ..... 139/7 A
6,293,314 B1 * 9/2001 Dewispelaere ..... 139/2
6,701,970 B2 * 3/2004 Burton ..... 139/7 A

FOREIGN PATENT DOCUMENTS

| | | |
|---|---|---|
| EP | 0 058 510 A | 8/1982 |
| GB | 2 190 107 A | 11/1987 |
| WO | WO 95 31594 A | 11/1995 |
| WO | WO 01 88240 A1 | 11/2001 |

* cited by examiner

*Primary Examiner*—Danny Worrell
(74) *Attorney, Agent, or Firm*—Sughrue Mion, PLLC

(57) ABSTRACT

A yarn tuft forming unit (1) comprises a yarn selector wheel (20) with provision for holding a number of different yams (23) arranged generally radially, means (21) to drive the selector wheel (20) into a selected one of a number of angularly discrete positions to bring a selected yarn (23) to a loading position, a puller (29) for engaging the selected yarn (23) at the loading position and pulling a predetermined length of the selected yarn (23) from the selector wheel (20), and a cutting mechanism (28) to cut the selected yarn (23) to form a tuft (7) of predetermined length. Such a tuft forming unit (1) is preferably used to supply yarn tufts (7) to an Axminster carpet weaving loom. Typically a number are provided across the width of the loom and together they traverse the whole width of the loom to provide yarn tufts (7) for a complete row of carpet. Each tuft forming unit (1) provides tufts for a significant number of weaving points and thus a considerable reduction in the size of the creel can be obtained.

17 Claims, 11 Drawing Sheets

YARN TUFT FORMING UNIT AND LOOM

BACKGROUND TO THE INVENTION

In making carpet, particularly patterned Axminster carpet, a yarn tuft forming unit is used to provide yarn of a particular colour to each weaving point of the carpet. In conventional Axminster weaving there are two principal ways which the yarn tuft formation is carried out. The first way is on a Jacquard Axminster loom, and the second is on a spool Axminster loom.

On a gripper Jacquard Axminster loom each weaving point includes a yarn carrier which is normally fed by eight yarns usually of different colour and the Jacquard mechanism moves the carrier to bring a selected yarn to the yarn selection position. A gripper moves towards the carrier, grips the yarn at the yarn selection position then relative movement apart of the gripper and the carrier pulls a predetermined length of yarn from the carrier. The yarn is then cut to form a tuft and moved by the gripper to the weaving point. The tuft carried by the gripper is of the appropriate colour for the tuft to be supplied to the next row of carpet to be woven. For a conventional 12 foot (4 m) loom there are over a 1000 weaving points across the loom and thus the creel supplying yarn to the loom has to have the potential of carrying over 8000 yarn packages. Typically, when the creel includes measured quantities of yarn in each tarn package an allowance of an additional eighteen metres of yarn is provided in each yarn package. Accordingly, the greater the number of yarn packages the greater the wastage. In spite of such a large creel size a designer of such carpets is relatively limited since the number of colours available for each column of tufts extending in the warp direction of the finished carpet and corresponding to a single weaving point is limited to only eight throughout each pattern repeat. Jacquards are also known in which the yarn carrier can hold sixteen different yarns. These require an even larger creel.

Spool Axminster looms provide a designer with greater flexibility. In spool Axminster looms a separate spool is provided for each row of the pattern repeat and each spool has a separate yarn winding for each weaving point along each row. Therefore, at least theoretically, the designer has an infinite number of colour choices for each column and row of each pattern repeat. However, in practice, as the number of colour choices used for each column and row of the design increases, the number of yarn packages needed for the spool winding operation also increases. Further, the spool winder must be set up differently for the winding of each spool which is time consuming. When a large number of different colours are used in both the column and row or warp and weft direction of each pattern repeat the number of different coloured yarn packages supplying the spool winder can be even larger than those on a creel of a typical Jacquard Axminster loom. The pattern repeat on spool looms is limited by the number of spools available in the spool chain. Further, there is considerably greater yarn wastage from a spool Axminster loom than a gripper Axminster loom because, on completion of a run, waste is generated from each weaving point of each row of the pattern repeat.

DISCUSSION OF PRIOR ART

In both the Jacquard and spool Axminster looms a row of tufts for a complete row of the carpet is created simultaneously and transferred to the weaving point at which they are woven into a backing to produce the carpet. An entirely different approach to yarn selection for carpet production has recently been proposed in WO 95/31594. In this, it is proposed that tufts of yarn to form a row of the carpet are produced by first loading yarn tufts into a tuft carrier and then transferring the yarn tufts from the tuft carrier to the weaving points. To achieve this a large number of different tuft forming units, typically one per weaving point, are provided along the length of a path with typically each tuft forming unit being supplied with yarn of only a single colour. As the tuft carrier is moved along the path it receives tufts of appropriate colour in each of its tuft holding sites. The tuft carrier is subsequently moved so that all the tufts for each row can be gripped by grippers and transferred to the weaving point simultaneously. Thus, the tufts are not usually all formed simultaneously and hence the tuft formation is, at least to some extent, decoupled from the weaving operation. Therefore, tuft formation can take place at the same time as the weaving operation and thus tuft formation can take place substantially continuously throughout the operation of the loom. This is to be contrasted with the conventional spool or gripper type looms where tuft formation takes place over only about half of each weaving cycle.

In examples given in WO 95/31594 it is suggested that partly as a result of forming the tufts throughout the entire weaving cycle it is possible to, for example, increase the speed of the tuft forming operation by four times. It is also explained that if this were possible and it was intended to operate the loom at the same speed as a conventional loom then it would be possible to reduce the size of its creel by a quarter since, in effect, each tuft forming unit would supply tufts for four weaving points. However, nowhere in this document does it exemplify an arrangement in which there are less yarn packages than the number of weaving points.

Whilst the above document specifically exemplifies only the supply of yarn of a single colour to each tuft forming unit it does disclose the theoretical possibility of providing yarn of a number of different colours to each tuft forming unit and somehow, in an unspecified way, selecting yarn of an appropriate colour for each weaving point. If this teaching is followed the creel size would not be reduced significantly. The above document also discusses the theoretical possibility of holding the yarn carrier stationary whilst moving the tuft forming unit. However, neither of these theoretical possibilities are exemplified nor is it explained how they could be achieved nor what advantages would accrue.

In WO 01/88240, a carpet weaving loom is described which includes one or more tuft forming units, the or each of which supplies tufts to a large number of weaving points, typically a number of tens of weaving points, sequentially. A loom, particularly one for producing samples may have only a single tuft forming unit and this may supply tufts for three hundred or more weaving points. Typically, for carpet production the loom includes a plurality of tuft forming units and each supplies tufts for between twenty and one hundred and twenty weaving points. With such an arrangement a great reduction in the number of yarn packages in the creel is obtainable since the potential number of yarn packages is that needed conventionally divided by the number of weaving points supplied by the or each tuft forming unit so reducing it to below one hundred in some instances, whilst also giving the designer a greater number of colour choices in each column of tufts extending in the warp direction.

SUMMARY OF THE INVENTION

According to a first aspect of this invention a yarn tuft forming unit comprises a yarn selector wheel with provision for holding a number of different yarns arranged around it, means to drive the selector wheel into a selected one of a number of angularly discrete positions to bring a selected yarn to a loading position, a puller for engaging the selected yarn at the loading position and pulling a predetermined length of the selected yarn from the selector wheel, and a cutting mechanism to cut the selected yarn to form a tuft of predetermined length.

The yarns may be arranged around the periphery of the selector wheel and extend in a direction generally parallel to its axis of rotation, but, preferably the yarns extend generally radially to the periphery of the wheel. Typically, such a yarn selector wheel has provision for containing more than 10 different yarns and typically 12,16,24 or 32 different yarns. Preferably the selector wheel is driven into and between its predetermined angular positions by a servomotor under the control of a computer.

Preferably the motion required to operate the cutter, provide opening and closing movement of the jaws of the puller, and to move the puller forwards and backwards to pull yarn from the selector wheel and in turn from the creel are all driven from a so-called "gearbox" forming part of the tuft forming unit. The gearbox may be driven by a servomotor under the control of a computer and in this way it can be ensured that the timing of the puller and cutter movements can be synchronised with the rotation of the selector wheel.

Alternatively a separate computer controlled servomotor may be provided to drive each motion of the cutter and puller and, in this case, the computer ensures the appropriate timing of the motions in synchronism with the rotation of the selector wheel.

One of the most significant contributions to the speeding up of the tuft forming means is the arrangement of the so-called gearbox that provides the puller and cutter motions in the tuft forming unit. Preferably the gearbox comprises a housing carrying three parallel shafts on which are mounted three equal size pinions meshed together. One of the shafts is driven, typically by a servomotor, and all three shafts or pinions carry eccentric pins. One end of the puller is pivoted to the housing and its other end is bifurcated to provide a pair of jaws. One of the eccentric pins is connected to a rod mounted for sliding movement along the puller body and carrying an orthogonal jaw operating pin. The eccentric pin causes the puller to pivot backwards and forwards and the orthogonal jaw operating pin to move up and down. The up and down movement of the jaw operating pin between facing cam surfaces of the bifurcated jaws causes the jaws to open and close. Thus the puller moves forward, the jaws close, the puller moves backwards, the jaws open and the cycle is repeated for each rotation of the shaft. Another of the eccentric pins drives a knife blade via a link to cut the yarn to form a tuft. Another important preferred feature of the tuft forming unit is to handle the tuft positively at all times so that it is always under control. One way of achieving this is to include a pair of cheeks spaced apart and mounted perpendicularly to the knife blade. As the knife blade is lowered to cut the yarn to form a tuft, the yarn to form the tuft is trapped between the cheeks so that, even when released from the puller and cut, it is still held positively between the cheeks. In this case the tuft forming unit preferably includes a pusher which passes between the cheeks to push the tuft out from between them. The pusher is driven via a link and a centrally pivoted first order lever from the remaining eccentric pin. The cheeks may be arranged to move up and down and also be driven from the remaining eccentric pin, or by being mounted on the knife blade. The eccentric pins are timed with respect to one another so that the yarn is held between the cheeks; the tuft is released from the jaws of the puller but is still held between the cheeks; the pusher initially engages the yarn whilst it is held between the cheeks; then the yarn is cut to form the tuft; and then the pusher finally pushes the cut tuft out from between the cheeks.

Preferably the tuft forming unit also includes a yarn detector to ensure that yarn is present between the puller and the selector wheel after the puller has moved away from the selector wheel. Typically this yarn detector is formed by a simple light emitter and detector arrangement on opposite sides of the path of the yarn. In this way when the optical detector detects the presence of light emitted by the emitter this indicates that no yarn is present. Typically, such an indication is used to stop the operation of the tuft forming unit until any problem has been rectified to ensure that each and every tuft required is formed correctly.

According to a second aspect of this invention an Axminster carpet weaving loom includes one or more tuft forming units in accordance with the first aspect of the invention, means to receive tufts sequentially cut by the tuft forming units, and transfer means to transfer all of the cut tufts simultaneously to their weaving points.

The carpet weaving loom may be formed in a way which is generally similar to that described in WO 95/31594 in which the or each tuft forming unit remains generally stationary and feeds tufts into a tuft carrier which moves longitudinally past the or each tuft forming unit. The tuft carrier is then transferred to a position to enable the tufts for a whole row to be taken from it simultaneously to be woven into a carpet. Alternatively, the or each tuft forming unit is arranged to traverse all or part of the width of the loom and provide tufts for the weaving points passed as the tuft forming unit or units move transversely across the loom. In the case of multiple tuft forming units they are preferably substantially equidistantly spaced across the loom.

As an example of the latter of these, the means to receive and hold yarn tufts may be formed by a series of yarn tuft carriers which extend transversely across the loom. The, or each tuft forming unit moves along one of the tuft carriers filling each of its tuft retention sites in turn with sequentially cut tufts, and, once all of the sites have been filled that tuft carrier is moved towards the transfer means and an empty yarn tuft carrier is moved into position adjacent the or each tuft forming unit. The yarn tuft carriers may be mounted equiangularly spaced around an axis and rotated as each yarn tuft carrier is filled. Alternatively they may be mounted parallel to one another on an endless belt which moves the yarn tuft carriers from adjacent the or each tuft forming unit to the transfer means. The transfer means preferably correspond to the gripper arrangement of a conventional gripper Axminster loom which grips the cut tufts held in the tuft carrier and move them to the weaving point at which they are woven into the carpet and released.

In another example the means to receive and hold yarn tufts may include a pocket which is associated with each weaving point and which receives the yarn tuft after it is formed by the or each tuft forming unit. Each tuft may be directed towards its associated pocket by an air flow created by applying a vacuum to the particular pocket next to receive a cut tuft. Preferably the vacuum is applied to the pockets in turn as the or each tuft forming unit moves along the row of pockets. One way of achieving this commutation between the supply of vacuum and the pockets is to provide an elongate vacuum chamber with an apertured sliding front plate; the plate being arranged to move with the tuft forming unit or units transversely across the loom so that the aperture or apertures in the plate are aligned with air exhaust ports of a particular pocket or particular pockets as the tufts for that pocket or those pockets are cut. The air flow entrains each cut tuft and guides it into its respective pocket.

Preferably the pockets are bounded at their bases by retractable pins and whilst the tufts are being formed the pins are in their forwards position defining a floor for each of the pockets. The pockets that hold each tuft are preferably formed at the upper end of a channel and when all of the pockets have been loaded with cut tufts, the pin floor is retracted and then punchers, one for each pocket, are rotated to engage each tuft and push it along its respective channel to engage it with a nose board of the loom. As the punchers withdraw, the tufts are then woven into the backing and once the punchers have withdrawn, tufts to form the next row are fed into the pockets. In this example the channels and punchers thus form the tuft transfer means.

A rapier drive for weft insertion, the shedding of the warp threads and a lay beam with beat up reeds for a beat up operation on the woven in tufts are provided in both of the above examples and, in general, there are entirely conventional in arrangement and operation.

By providing sufficient tuft forming units the loom can operate as fast as a conventional gripper Axminster loom and so weave at a rate of about forty rows of tufts per minute. With the time saved in threading up the loom and creel there is a great reduction in "downtime" which leads to a considerable increase in carpet production from each loom and which typically provides an increase in choice of colours throughout with less waste of yarn. It is also possible to have fewer tuft forming units and have the loom operating at a slower weaving speed than a conventional loom and yet achieve a similar carpet output as a result of the shorter "downtime" offsetting the slower weaving speed.

BRIEF DESCRIPTION OF THE DRAWINGS

Particular examples of a loom in accordance with this invention will now be described with reference to the accompanying drawings, in which.

DESCRIPTION OF PARTICULAR EMBODIMENTS

Figure 3:
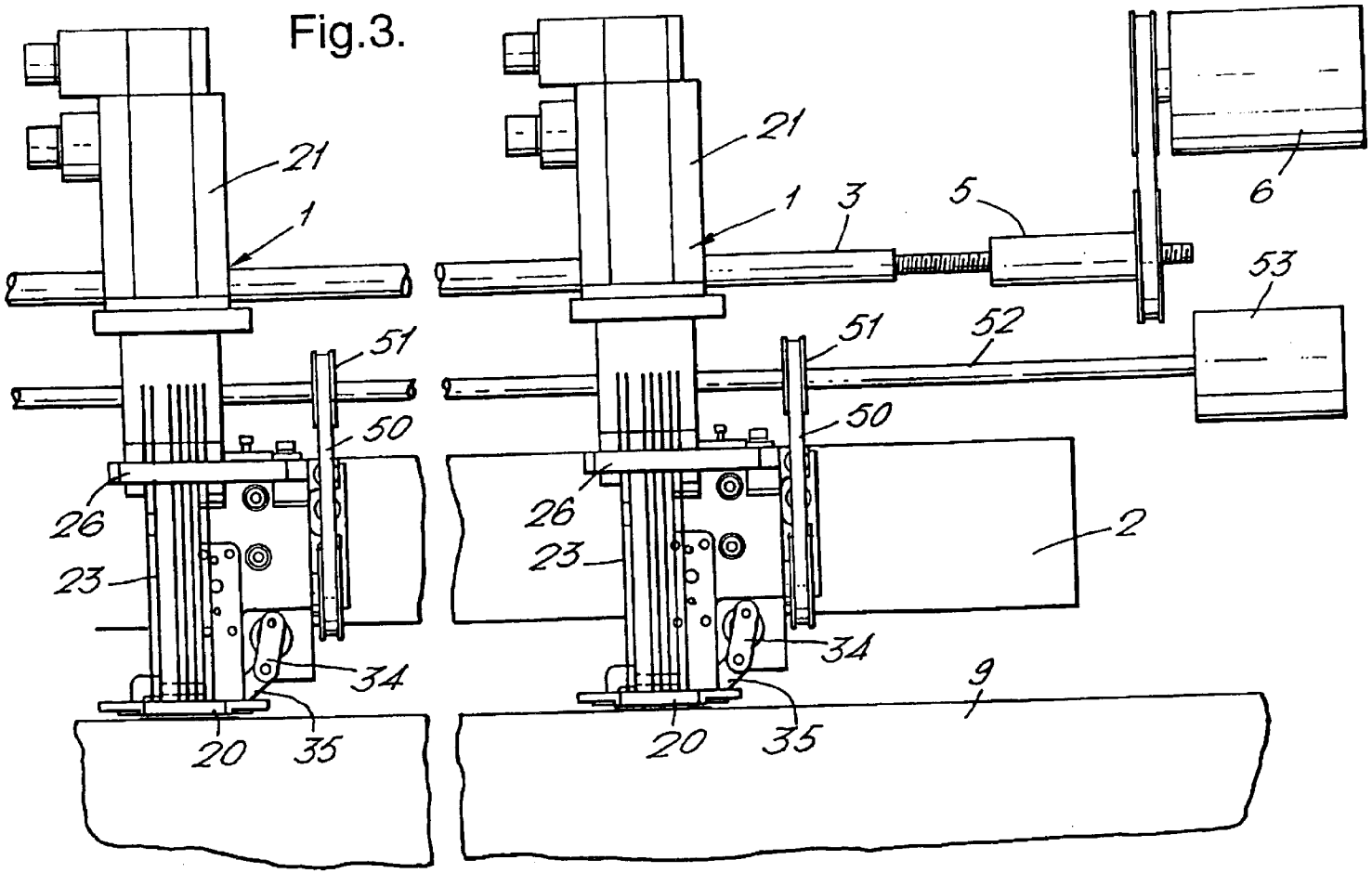
FIG. 3 is a partial front elevation of the first example of loom.

Both examples of Axminster loom are capable of weaving 12 foot (4 metre) wide Axminster carpet at a pitch of seven tufts per inch (25.4 mm). Tuft yarn is supplied from a creel (not shown) to twelve tuft forming units 1, equidistantly spaced across the loom. The tuft forming units 1 are mounted on a common framework. The framework and tuft forming units are moveable transversely backwards and forwards across the loom by a recirculating ball nut assembly 5 driven from a servomotor 6 (shown in FIGS. 3 and 11).

Figure 1:
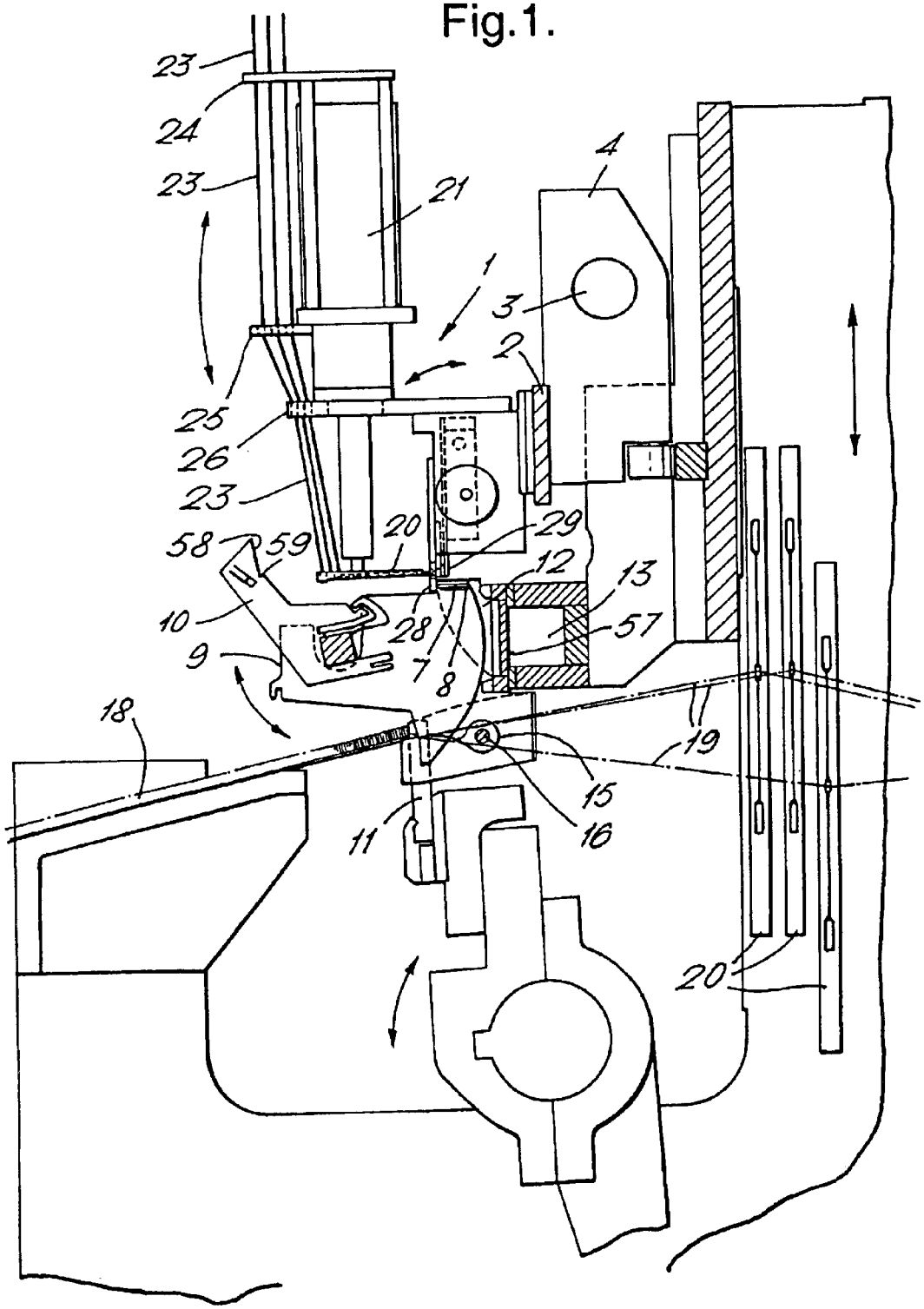
FIG. 1 is a sectional side elevation of a first example of loom during the tuft forming process and showing the puller in a first position.
Figure 2:
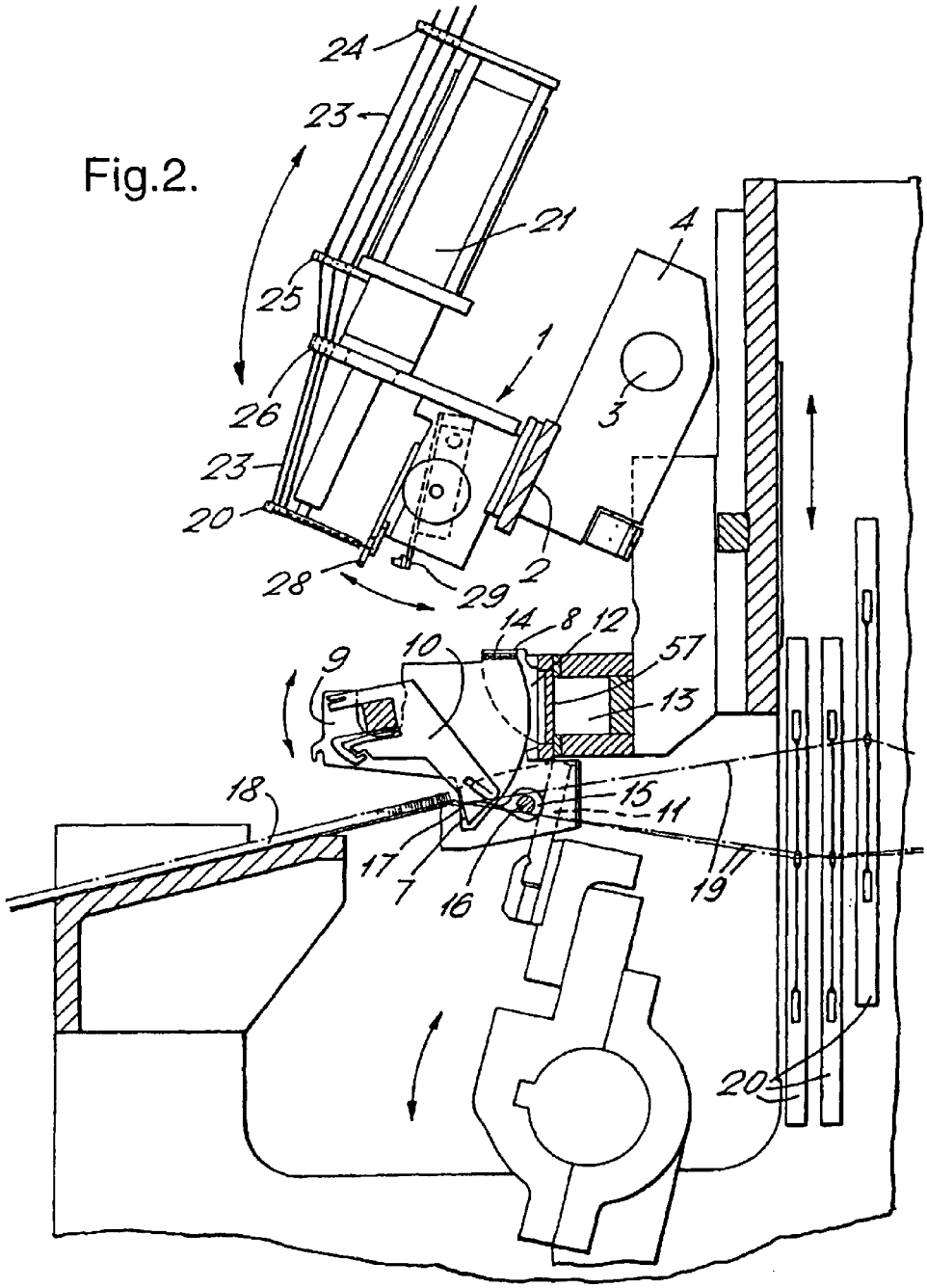
FIG. 2 is a sectional side elevation of the first example of loom during the tuft transfer operation and showing the puller in a second position.

In the first example the framework includes plate 2, shaft 3 and hangers 4, and can also be pivoted about the shaft 3 by a pneumatic ram (not shown) so that the yarn transfer units 1 move between the positions shown in FIGS. 1 and 2. The tuft forming units 1, which will be described in more detail subsequently, form tufts 7 which fall into pockets 8 formed in the top of a fin pack assembly 9. The fin pack assembly 9 consists of a number of parallel plates separated by shaped spacers to provide clearance between adjacent plates for passage of punchers 10 and beat up reeds 11. The spacers also define an air channel 12 between each pocket 8 and a vacuum chamber 13. The air channels terminate in a series of rounded apertures 14 located at the side of each of the pockets 8. The fin pack 9 also includes an aperture 15 for the needle or rapier 16 and weft threads.

After the tuft forming units 1 have loaded tufts 7 into each of the pockets 8, the tuft forming units 1 are pivoted into the position shown in FIG. 2 and then the punchers 10 rotate in the clockwise direction, as shown in FIG. 1, to transfer the cut tufts 7 from the pockets 8 to a position against a nose board 17 where they are woven into the backing of a carpet by weft threads inserted by the rapier 16. The punchers 10 return to their initial position to allow the tuft forming units 1 to pivot backwards and start loading the pockets 8 with further tufts 7 to form the next row whilst the reeds 11 perform a beat up operation on the row of tufts that have just been woven in to produce the finished carpet 18. Stuffer and chain warp yarns 19 pass through a conventional shedding arrangement 20 to shed the warp yarns 19 between each lash of the rapier 16.

Figure 4:
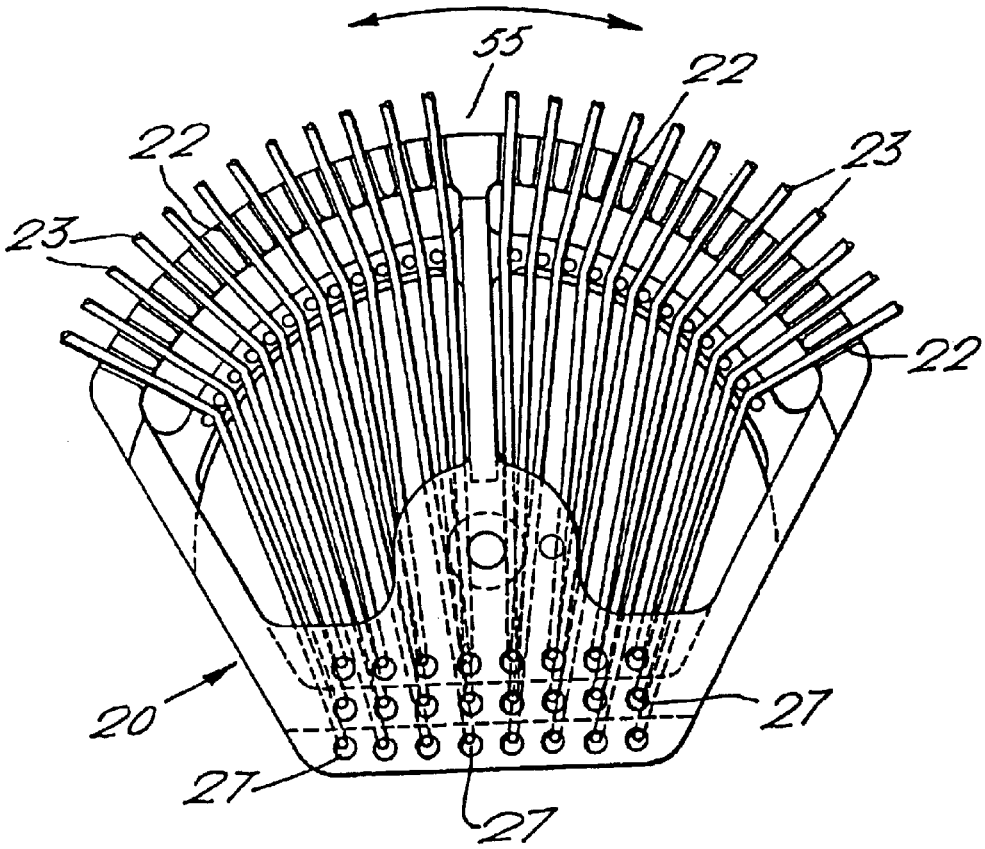
FIG. 4 is an underplan of the selector wheel to a larger scale.

Each tuft forming unit 1 includes a rotatable selector wheel 20, shown most clearly in FIG. 4, which is mounted on a shaft driven by a servomotor 21. The selector wheel 20 includes twenty-four generally radially extending channels 22 each of which carries a tuft forming yarn 23 of a different colour. The tuft forming yarns 23 are fed from the creel to the tuft forming units using entirely conventional yarn tubes and guides and then pass through multi-aperture guides 24, 25 and 26 before passing through a series of apertures 27 formed in a portion of the selector wheel 20. The yarns are held in place in the channels 22 by spring fingers (not shown).

Figure 5:
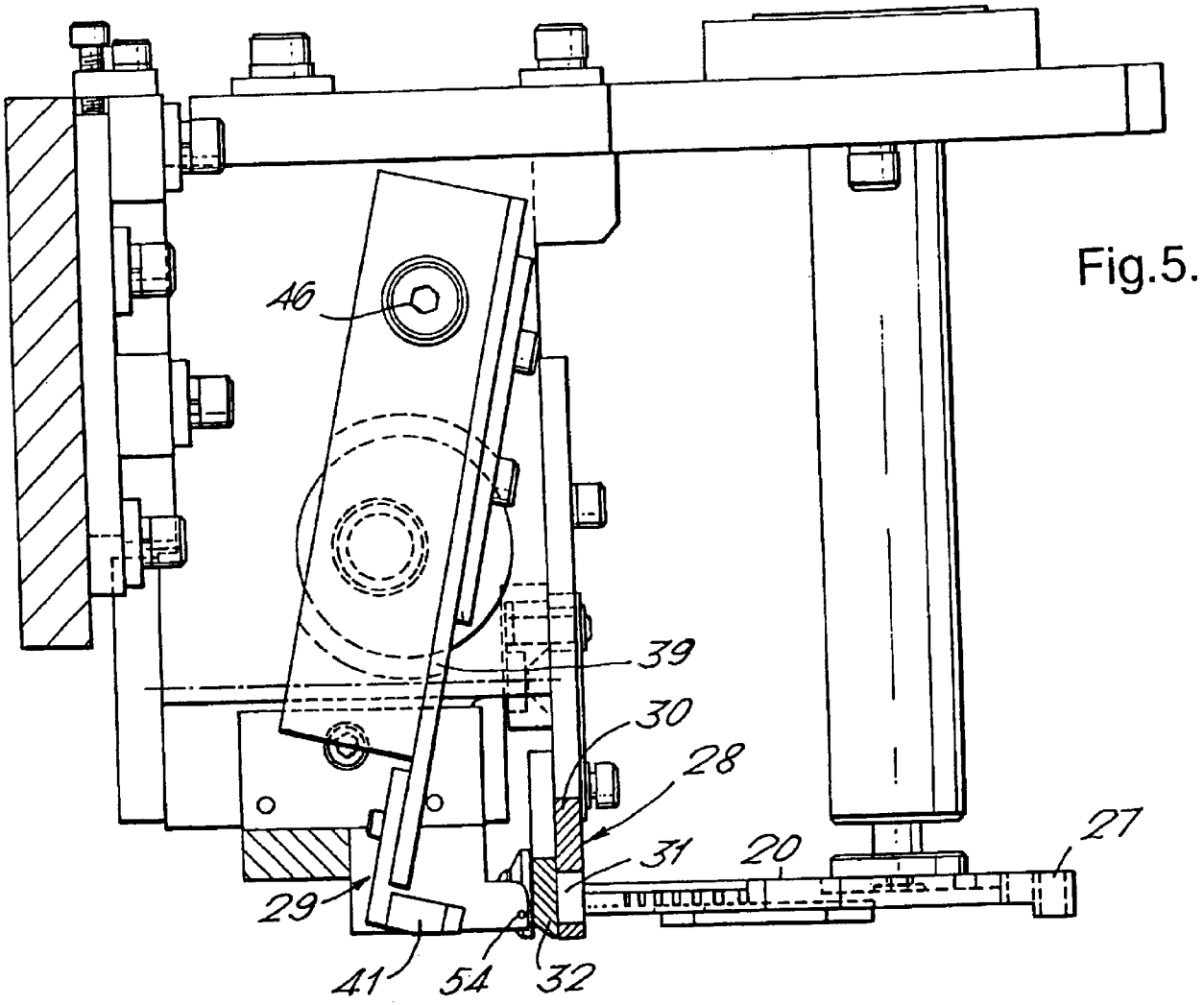
FIG. 5 is a sectional side elevation of a first example of tuft forming unit drawn to a larger scale and from the opposite direction.
Figure 6:
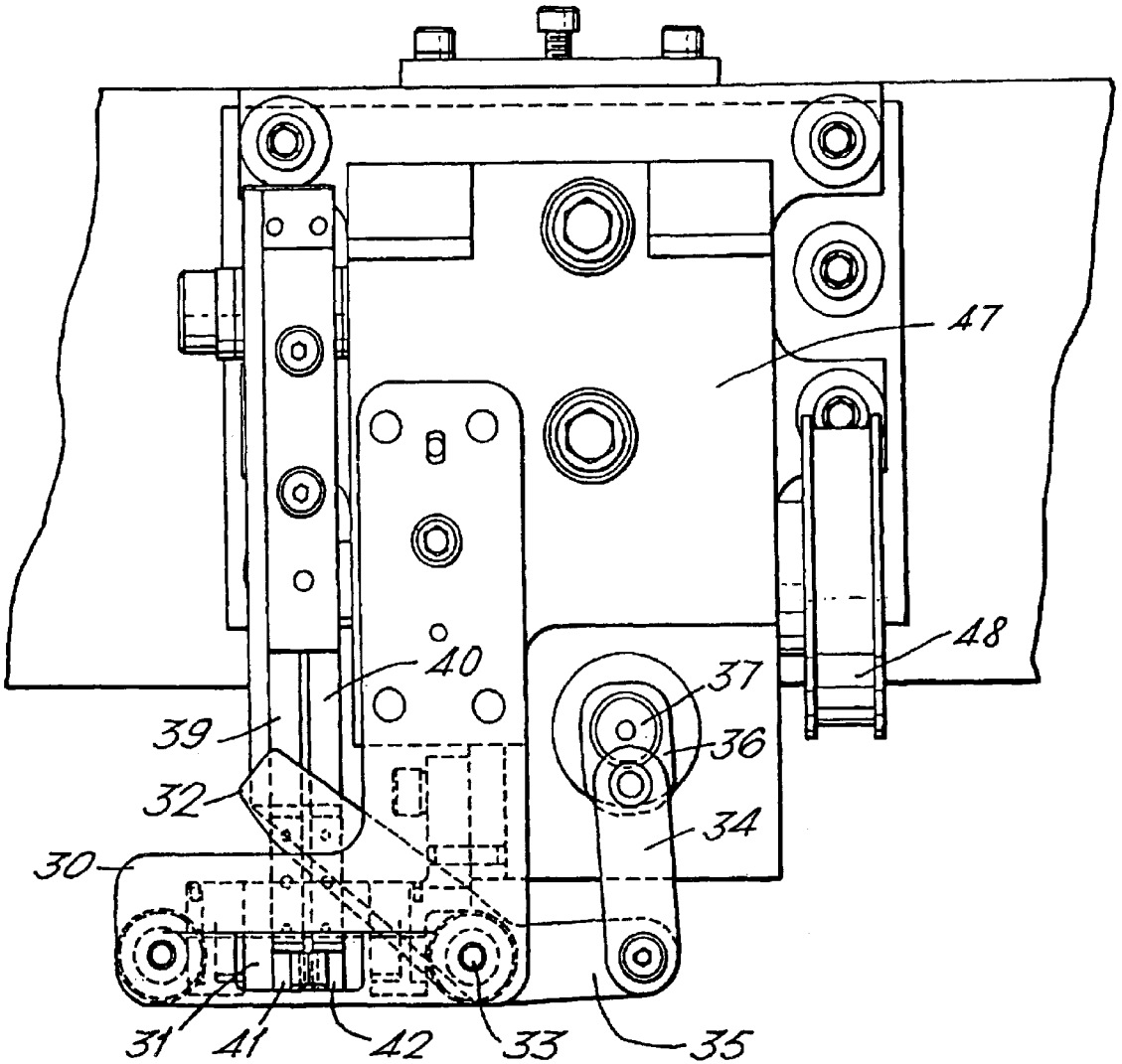
FIG. 6 is a front elevation of the first example of tuft forming unit drawn to a larger scale showing the cutter.
Figure 7:
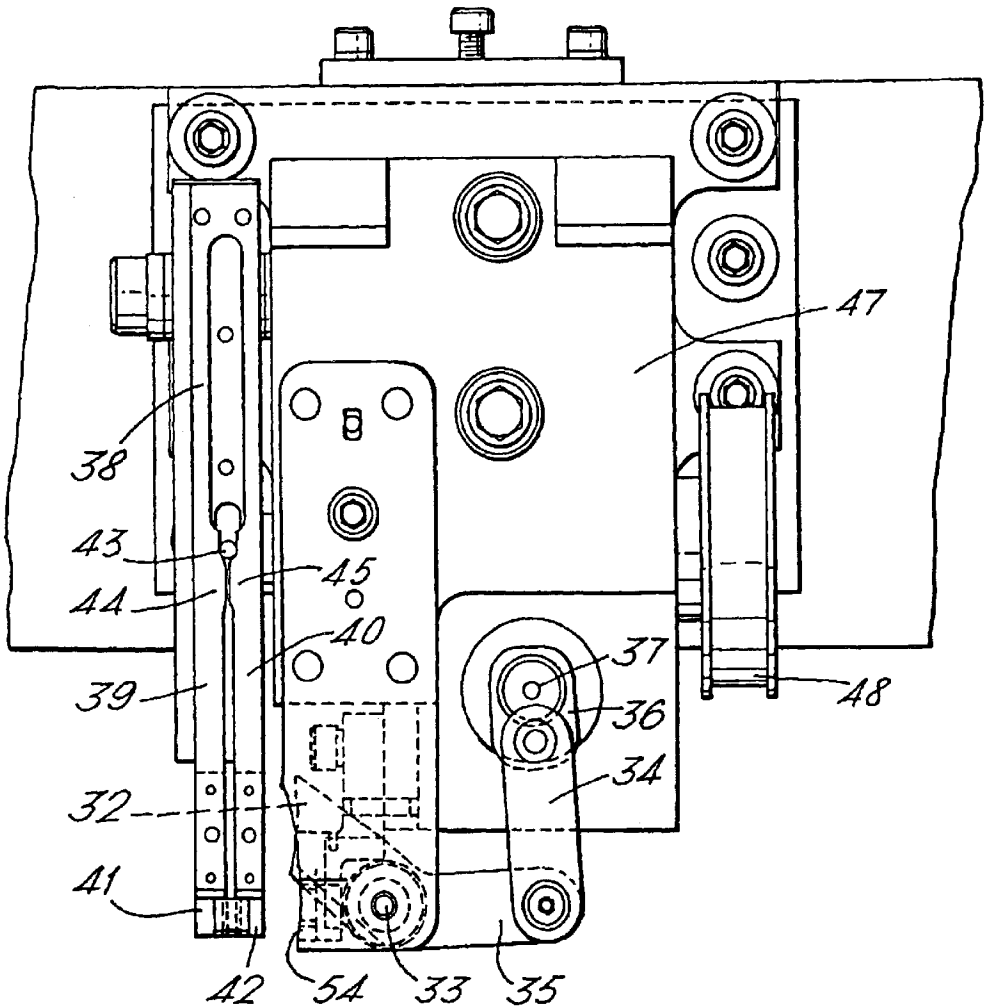
FIG. 7 is a front elevation similar to FIG. 6 but with part of the cutter cut away to show the puller in more detail.

Each tuft forming unit 1 also includes a cutter 28 and puller 29 which are shown most clearly in FIGS. 5, 6 and 7. The cutter 28 comprises a fixed blade 30 with an aperture 31 and a moving blade 32. The aperture 31 is adjacent the edge of the selector wheel 20 and the free ends of the yarns 23 extending radially outwards from the selector wheel 20 extend into the aperture 31. The moveable blade 32 is pivoted around a pivot 33 and driven by a pivoted link 34, pivotally connected to a crank 35 forming part of the moving blade 32 and a crank 36 mounted on shaft 37. The puller 29 comprises a generally U-shaped portion 38 with elongate parallel limbs 39 and 40 and gripping jaws 41 and 42 secured to their free ends. This is shown most clearly in FIGS. 5 and 7. The gripping jaws 41 and 42 are normally held closed by the resilience of the U-shaped portion 38. However, by moving a pin 43 downwards as shown in FIG. 7 between a pair of raised cam-surfaces 44 and 45, the limbs 39 and 40 move apart and so open the jaws 41 and 42. The puller 29 is also mounted for rotation about shaft 46, shown in FIG. 5, between the position shown in FIG. 5 and a forwards position shown in FIG. 1 with the gripping jaws 41 and 42 extending into the aperture 31 in the fixed cutting knife blade 30 and adjacent the selector wheel 20.

The rotation of the shaft 37, the up and down movement of the pin 43 and the oscillation of the shaft 46 are all driven through a gearbox 47 which will be described in more detail subsequently. The gearboxes 47 are all driven from a toothed pulley 48 mounted on a shaft, not shown. The pulleys 48 of all of the tuft forming units 1 are driven via toothed belts 50 from pulleys 51 mounted on a shaft 52 driven by a servomotor 53, shown in FIG. 3. The shaft 52 and servomotor 53 are mounted on the frame 2, 3 and 4 and so move transversely with the tuft forming units 1.

A light emitting diode and photo detector (not shown) are coupled to ends of optical fibres which are located in apertures 54 located between the jaws 41 and 42 and the knife 28. When the puller 29 has gripped the free end of one of the yarns 23 and pulled it out, and before the knife 28 operates, the yarn 23 is positioned in between the optical fibre coupled to the photo detector and that coupled to the photo emitter and so blocks light from the emitter reaching the detector. Provided light from the photo emitter is prevented from reaching the photo detector at this time it is assumed that a yarn has been successfully pulled out of the selector wheel 20 by the puller 29. However, if at this time in the operating cycle of the tuft forming unit light from the photo emitter is detected by the photo receiver then it is assumed that the tuft has not been correctly formed and a stop signal is given to the loom to prevent its further operation until the situation has been rectified.

During each tuft forming cycle the servomotor 21 drives the selector wheel 20 into a predetermined angular position so that either a blank space 55 at a central position is adjacent the puller 29 or one of the yarns 23 is adjacent the puller 29. During each tuft forming cycle the puller rotates in the anti-clockwise direction as shown in FIG. 5 around the axis of shaft 46 so that the jaws 41, 42 move forward and close together, then, the puller rotates clockwise about the axis of shaft 46 so that the jaws move backwards and then the jaws 41 and 42 open. Thus, during each tuft forming cycle either a central blank position 55 is adjacent the puller when no carpet is to be woven, or yarn of a selected colour is presented to the puller 29 upon indexing of the selector wheel 20 to the required angular position. Thereupon the puller 29 grabs the yarn end presented to it, pulls a predetermined length of yarn, typically half of an inch (12.5 mm), from the yarn supply on the creel and then the yarn is severed by the knife 28 to produce a yarn tuft 7. The selector wheel 20 is then free to rotate to a different angular position to provide the next tuft to be formed. The puller 28 then releases the yarn before moving forward again to form the next yarn tuft 7.

The operation of the servomotor 21, the servomotor 6 and the servomotor 53 are all controlled by a computer driven controller to ensure that appropriate coloured yarns are provided to each weaving point to provide the required pattern in the resulting carpet 18. The computerised controller has inputs corresponding to the transverse position of the tuft forming units 1 across the width of the loom and for any particular row of a pattern which is to be woven at any instant, to enable it to control the tuft forming units 1 effectively.

After the tuft 7 is formed, cut by the knife 28 and released by the jaws 41, 42 of the puller 29 it is pulled down into the required position in the pocket 8 by an air flow generated by the vacuum chamber 13. The front of the vacuum chamber 13 is closed by a sliding shutter plate 57 containing twelve slots, the number corresponding to a number of tuft forming units 1. The sliding shutter plate 57 is connected to the framework 2, 3 and 4 and so moves with the tuft forming units 1. Each of the apertures in the sliding shutter plate 57 is generally aligned with its respective tuft forming unit 1 so that when the tuft forming unit 1 is in place above a particular pocket 8 the aperture in the shutter is aligned with the rear edge of the arcuate channel 12 to apply a vacuum to the rear of channel 12 and hence to the apertures 14 so that air is drawn into the pocket 8, through the apertures 14, through the arcuate channel 12 and into the vacuum chamber 13. It is this airflow which entrains the tuft 7 after it is cut by the cutter 28 and released by the puller 29 to pull the tuft down into the pocket 8. The bottom of each pocket 8 is defined by a retractable pin (not shown). As the tuft forming units 1 move along so the sliding shutter commutates the vacuum from the chamber 13 to the next pocket 8, and so on across the width of the loom.

Once all of the pockets 8 have been loaded with tufts 7 the tuft forming units 1 are pivoted into their position shown in FIG. 2 and the pins forming the floor of each of the pockets are retracted. The punchers 10 then rotate in a clockwise direction and so move forwards and downwards. An angled face 58 on each of the punchers 10 engages its corresponding tuft 7 to push it downwards between adjacent fins of the fin package 10. By providing a predetermined angle on the contact face 58 of the puncher 10 and, in particular a notch 59 at the end of the contact face 58, whilst the puncher 10 is forcing the tuft 7 between adjacent fins of the fin package the tuft 7 moves along the angled face 58 of the puncher 10 until its end is stopped by the notch 59. This precisely locates the tuft 7 in a predetermined position so that when it reaches the weaving point defined by the nose board 17 it is in the correct location. At the weaving point the punchers 10 push the cut tuft 7 against the nose board 17 and then the tuft is woven into position by the application of weft threads using the rapier 16 as the puncher 10 returns anticlockwise to its starting position. To complete the formation of the carpet 17 a lay-beam with attached reeds 11 beats up the tuft and weft yarns to complete the formation of that row of carpet whilst the tufts 7 for the next row are being placed in the pockets 8.

Figure 8:
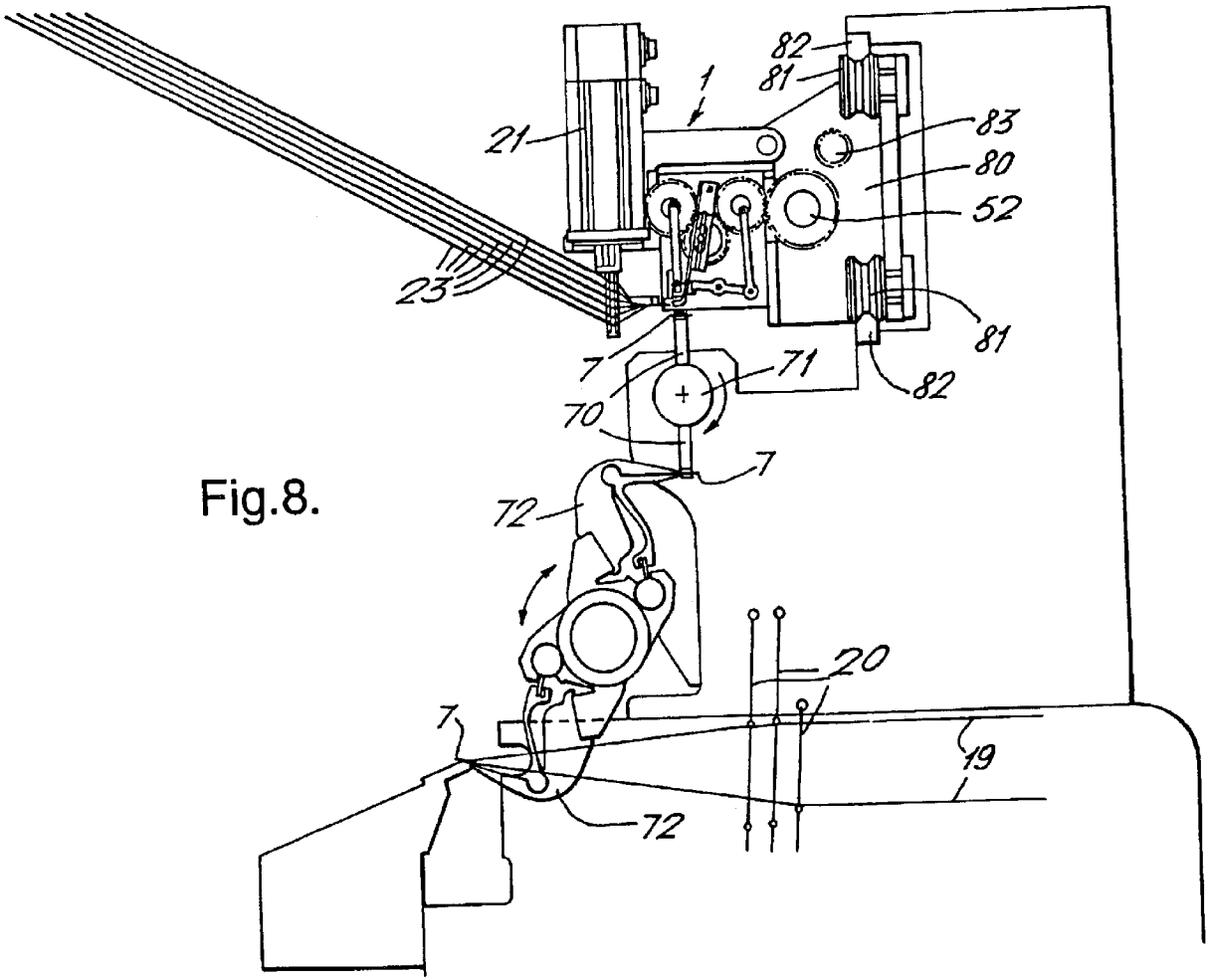
FIG. 8 is a sectional side elevation of a second example of loom during the tuft forming process.

The second example of loom shown in FIG. 8 is generally similar to the first, especially in operation, but instead of the finpack and punchers for transferring the cut tufts to the weaving point, it includes a pair of tuft carriers 70 mounted for rotation about an axis 71 and a set of conventional grippers 72 that are entirely conventional in construction and use. As the tuft forming units 1 traverse the loom, tufts are placed in tuft retention sites 73 formed along the top edge of the tuft carrier 70. When all of the tuft retention sites have been loaded, the tuft carrier 70 rotates clockwise (as seen in FIG. 8) about the axis 71 to move the loaded tuft carrier 70 into the lowermost position and to move an empty tuft carrier 70 into the uppermost position. The tuft forming units 1 then load tufts 7 into the uppermost tuft carrier 70 as they traverse backwards across the loom. The grippers 72 move upwards, clockwise as seen in FIG. 8, with their beaks open and then close to grip all of the tufts 7 held by the lowermost tuft carrier 70. The grippers 72 then rotate in the opposite direction to move the tufts 7 to the weaving point where the tufts 7 are woven into the carpet and the grippers 72 open to release the tufts 7. The beat up reeds 11 and rapier weft insertion mechanism have been omitted from FIG. 8 for clarity but are entirely conventional and similar to those used on conventional gripper Axminster carpet looms.

Another difference between the first and second examples is the mounting of the tuft forming units 1. In the second example the tuft forming units 1 are mounted on a framework 80 including grooved rollers 81 which run on beveled rails 82. This permits the tuft forming units 1 and the framework 80 to move transversely across the loom and once again it is driven by a recirculating ball-nut/screw mechanism 83 driven by servomotor 5.

Figure 9:
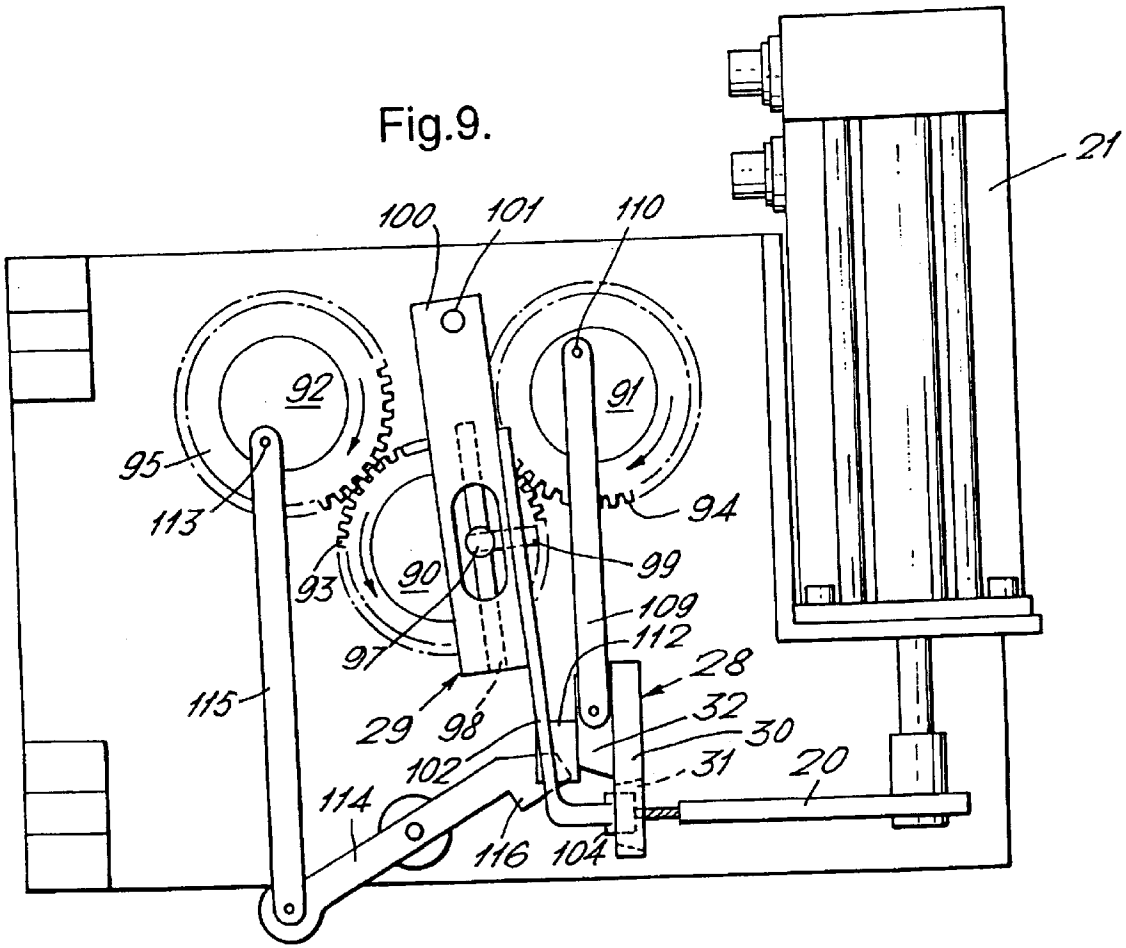
FIG. 9 is a simplified sectional side elevation of a second example of tuft forming unit, drawn to a larger scale and from the opposite direction, at the start of the tuft forming operation.
Figure 10:
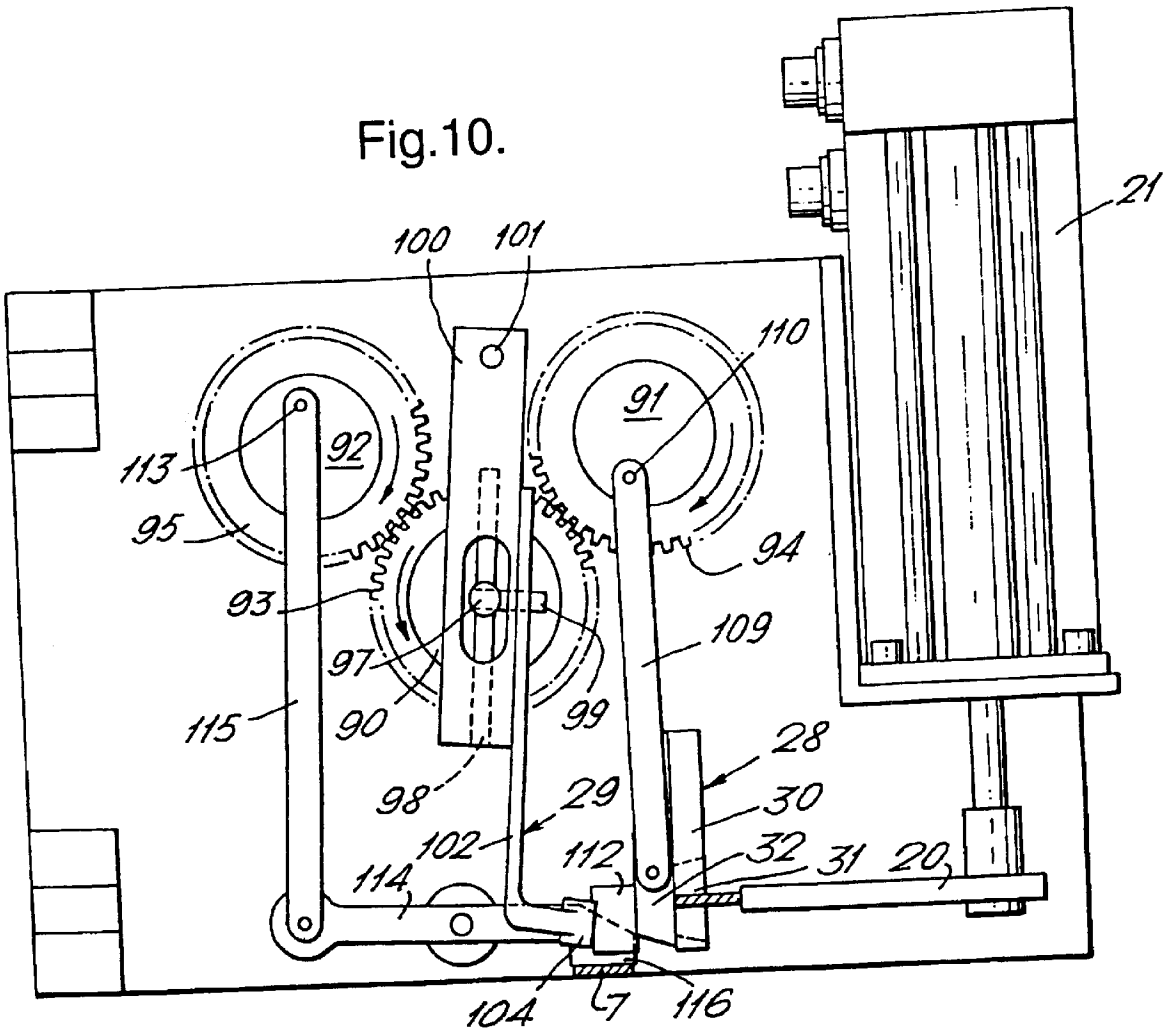
FIG. 10 is a simplified sectional side elevation of a second example of tuft forming unit, drawn to a larger scale and from the opposite direction, at the end of the tuft forming operation; and, FIG. 11 is a simplified front elevation showing two of the second examples of tuft forming units.
Figure 11:
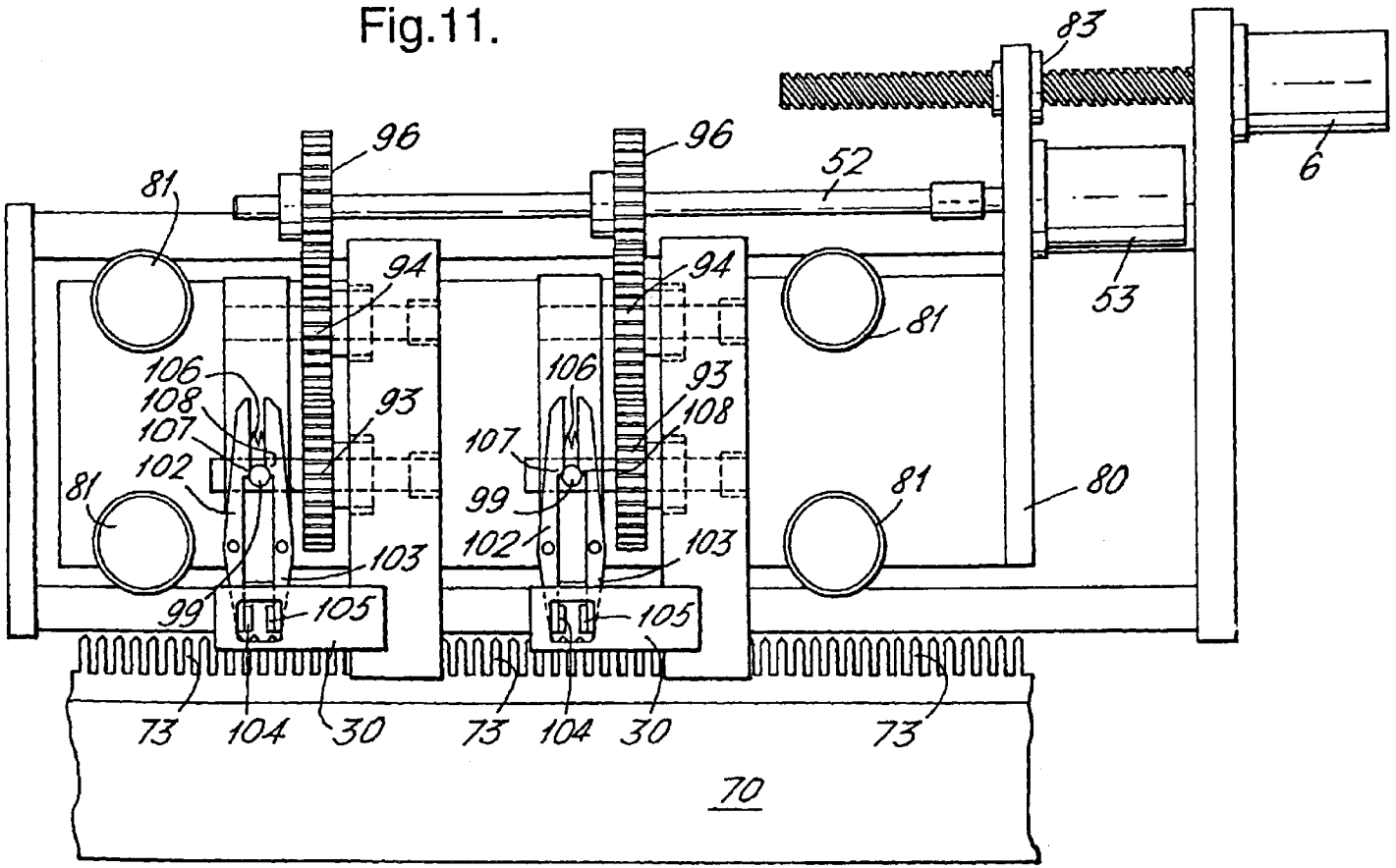

The second example of tuft forming unit 1 shown in simplified form for ease of explanation in FIGS. 8 to 11 provides positive handling of each yarn tuft 7 during its formation and upon insertion into each tuft holding site on yarn carrier 70 or into each pocket 8 so avoiding the need for the vacuum chamber 13 and airflow arrangements described previously. Each yarn tuft forming unit 1 includes a gearbox shown in a simplified fashion in FIGS. 9 to 11. It consists of three parallel shafts 90, 91, 92 on which are mounted three equal sized pinions 93, 94, 95 which are meshed together. One of the shafts 90, 91, 92 is driven directly by the servomotor 53 or via the toothed belt and pulley arrangement already described or by a further pinion 96 as shown in FIG. 11. All three shafts 90, 91, 92 are drilled to carry eccentric pins. Pin 97 is mounted in shaft 90 and is connected to rod 98 and pin 99. Rod 98 is journalled into body 100 of the puller 29 so that it can slide up and down as seen in FIGS. 9 and 10. The body 100 is pivoted at its upper end on pivot 101. Consequently, as shaft 90 rotates, counterclockwise as seen in FIG. 9, the pin 97 and rod 98 move up and down with respect to the body 100 and the body 100 is caused to pivot backwards and forwards about its pivot 101. In this example the puller includes a pair of pivoted limbs 102, 103 with jaws 104, 105 mounted at their lowermost ends. The upper ends of the limbs are urged together by a spring 106 to cause the limbs to pivot and open the jaws 104, 105. The pin 99 moves up and down with respect to cam surfaces 107, 108 on the limbs 102, 103 to urge the jaws 104, 105 together when in its uppermost position and, in its lowermost position, allow the limbs 102, 103 to respond to the bias exerted by the spring 106, to open the jaws 104, 105.

The moveable blade 32 of the knife assembly is driven up and down by a link 109 connected between the moveable blade 32 and an eccentric pin 110 mounted in the shaft 91. The rear face of the moveable knife blade carries a pair of guide cheeks 112 which locate between the limbs 102, 103 when they are in their forwards position. An eccentric pin 113 in the third shaft 92 drives one end of a first order lever 114 via a link 115. A pusher 116 located at the other end of the first order lever 114 moves up and down between the guide cheeks 112.

To produce each tuft, the yarn selector motor 21 rotates the selector wheel 20 to bring the selected yarn to a location adjacent the puller 29. The body 100 of the puller is pivoted forwards with the pin 99 towards its lowermost position so that the jaws 104, 105 are open. As the shaft 90 continues to rotate the pin 99 lifts and is moved between the cam surfaces 107, 108 so closing the jaws 104, 105 and clamping the free end of the yarn between them. Further rotation of the shaft 90 causes the body 100 of the puller 29 to pivot backwards so pulling yarn from the selector wheel 20. Rotation of shaft 91 causes the moveable blade 32 of the knife assembly 29 to move downwards. As the blade moves downwards the length of yarn being pulled by the puller 29 is trapped between the guide cheeks 112. Once the puller 29 has moved backwards to its maximum extent the continued downwards movement of the knife blade 32 cuts the yarn to form a tuft 7 which is held between the guide cheeks 112 as the knife blade 32 continues to move downwards on an overtravel. Meanwhile rotation of shaft 92 causes the pusher 116 to move downwards between the guide cheeks 112. Further rotation of shaft 90 causes the pin 99 to be lowered away from the cam surfaces 106, 107 so that the jaws 104, 105 open under the action of the spring 106. Further rotation of the shaft 92 brings the pusher into contact with the top of the tuft 7 held between the guide cheeks 112 and continued rotation of the shaft 92 causes the tuft 7 to be pushed into a tuft retention site 73 on the tuft carrier 71 or into the pocket 8 in the first example. Continued rotation of the shaft 91 moves the moveable knife blade 32 upwards. Meanwhile the yarn selector motor 21 moves the selector wheel 20 to bring the next yarn to be selected into position. Continued rotation of shafts 90 and 92 move the puller 29 forwards into position to grip the next yarn and move the pusher 116 upwards ready for the next cycle of operation.

With this second arrangement of tuft forming unit, since the tuft is positively held at all times, whether by the jaws 104, 105, the guide cheeks 112, or the pusher 116 the tuft is always at a known and fixed position. This leads to improvements in tuft placement in the carpet and hence to less waste of tuft yarn as a result of less material being removed during a subsequent shearing step. Positive handling of the cut tuft, particularly by the pusher 116 also enables the jaws 104, 105 to have matching serrated teeth so that they grip the yarn more positively whilst drawing the yarn through the selector wheel 20 and from the creel. Preferably the serrated teeth are similar to those used on the grippers of a conventional Axminster loom.

What is claimed is:

1. A yarn tuft forming unit comprising a yarn selector wheel (20) with provision for holding a number of different yarns (23) arranged around it, means (21) to drive the selector wheel (20) into a selected one of a number of angularly discrete positions to bring a selected yarn (23) to a loading position, a puller (29) for engaging the selected yarn (23) at the loading position and pulling a predetermined length of the selected yarn (23) from the selector wheel (20), and a cutting mechanism (28) to cut the selected yarn (23) to form a tuft (7) of predetermined length.

2. A yarn tuft forming unit according to claim 1, in which the selector wheel (20) has provision for holding the number of different yarns so that they extend generally radially outwards.

3. A yarn tuft forming unit according to claim 1 or 2, in which the yarn selector wheel (20) has provision for containing more than 10 different yarns and typically 24 or 32 different yarns.

4. A yarn tuft forming unit according to claim 1, in which the selector wheel (20) is driven into and between its predetermined angular positions by a servomotor (21) under the control of a computer.

5. A yarn tuft forming unit according to claim 4, in which the motion required to operate the cutting mechanism (28), provide opening and closing movement of jaws of the puller (29), and to move the puller (29) forwards and backwards to pull yarn (23) from the selector wheel (20), are all driven from a servomotor (53) under the control of the computer so that they are synchronized with the motion of the selector wheel (20).

6. A yarn tuft forming unit according to claim 1, in which the motion required to operate the puller and cutter is provided by a gearbox which comprises a housing carrying parallel shafts (90, 91, 92) on which are mounted equal size pinions (93, 94, 95) meshed together, the shafts or pinions carrying eccentric pins (97, 110, 113), one end of the puller (29).

7. A tuft forming unit according to claim 6, in which another of the eccentric pins (101) drives a knife blade (32) via a link (109) to cut the yarn to form a tuft (7).

8. A yarn tuft forming unit according to claim 1, in which a pair of spaced apart cheeks are mounted perpendicularly to a knife blade (32) of the cutting mechanism (28) and are arranged so that as the knife blade is lowered to cut the yarn to form a tuft (7), the yarn to form the tuft is trapped between the cheeks (112).

9. A tuft forming unit according to claim 8, which also includes a pusher (116) which passes between the cheeks (112) to push the tuft (7) out from between them.

10. A yarn tuft forming unit according to claim 1, which also includes a yarn detector to ensure that yarn (23) is present between the puller (29) and the selector wheel (20) after the puller (29) has moved away from the selector wheel (20).

11. An Axminster carpet weaving loom including a number of tuft forming units (1) in accordance with claim 1, means (8) to receive tufts (7) sequentially cut by the tuft forming units (1), and transfer means (10) to transfer all of the cut tufts (7) simultaneously to their weaving points.

12. An Axminster carpet weaving loom according to claim 11, in which the or each tuft forming unit (1) remains generally stationary and feeds tufts (7) into a tuft carrier which moves past the or each tuft forming unit (1), the tuft carrier (1) then being transferred to a position to enable the tufts (7) for a whole row to be taken from it simultaneously to be woven into a carpet (18).

13. An Axminster carpet weaving loom according to claim 11, in which the or each tuft forming unit (1) is arranged to traverse part of the width of the loom and provide tufts (7) for the weaving points passed as the or each tuft forming unit (1) moves transversely across the loom.

14. An Axminster carpet weaving loom according to claim 13, in which a plurality of tuft forming units (1) are substantially equidistantly spaced across the loom.

15. An Axminster carpet weaving loom according to claim 13, in which a pocket (8) is associated with each weaving point which receives the tuft (7) after it is formed by the tuft forming unit (1).

16. An Axminster carpet weaving loom according to claim 15, in which the tuft (7) is directed towards its associated pocket (8) by an air flow created, in use, by applying a vacuum to the particular pocket (8) next to receive a cut tuft (7).

17. An Axminster carpet weaving loom according to claim 15, in which the pockets (8) that hold each tuft (7) are each formed at the upper end of a channel and punchers (10), one for each pocket (8) are provided, in use, the punchers (10) being rotated to engage each tuft (7) and push it along its respective channel.

* * * * *